US005375842A

United States Patent [19]

Plottner

[11] Patent Number: 5,375,842

[45] Date of Patent: Dec. 27, 1994

[54] GOLFER'S HEAD MOVEMENT INDICATOR

[76] Inventor: Jarl V. Plottner, 1106 Field St. NW., Canton, Ohio 44709

[21] Appl. No.: 194,166

[22] Filed: Feb. 9, 1994

[51] Int. Cl.[5] ..... A63B 69/36

[52] U.S. Cl. ..... 273/187.2; 340/573

[58] Field of Search ..... 273/187.2, 190 R, 190 A, 273/183.1; 340/575, 573

[56] References Cited

U.S. PATENT DOCUMENTS

| | | | |
|---|---|---|---|
| 3,643,960 | 2/1972 | Gentilly | 273/187.2 |
| 3,774,572 | 11/1973 | Borraccio | 273/187.2 X |
| 3,806,131 | 4/1974 | Evans | 273/186.2 |
| 4,637,612 | 1/1987 | Wilkins | 273/187.2 |
| 4,743,028 | 5/1988 | Harrison | 273/187.2 |

*Primary Examiner*—George J. Marlo

[57] ABSTRACT

A golfer's head movement indicating device including a switch (30) enclosed in a pocket (50) and adapted to be attached to the outer garment of a golfer (10) at a location proximate to the upper front shoulder area (18) of the golfer (10), a signal device (A) connected to the switch (30) and a source of power (B) connected to the signal device (A) and the switch (30), said switch (30) including a pair of elongated contacts (32, 34) adapted to close in response to pressure exerted on the switch (30) by the golfer's shoulder (18) coming into contact with the golfer's chin whereby contact between the golfer's shoulder (18) and the golfer's chin closes the switch (30) to activate the signal device (A) to indicate that the shoulder (18) has contacted the chin.

4 Claims, 1 Drawing Sheet

GOLFER'S HEAD MOVEMENT INDICATOR

FIELD OF THE INVENTION

The present invention relates to a golfer's head movement indicator and more specifically the invention relates to a golfer's device for positively signaling that a golfer has maintained correct head position throughout his swing.

BACKGROUND OF THE INVENTION

The traditional concepts of a good golf swing involve a series of interrelated and interindependent actions on the part of the golfer. While no two golfers who possess a great amount of skill have identical golf swings, there are certain things involved in a good golf swing that a golfer must either do or not do. For example, it is often taught by golf instructors that a right-handed golfer should keep his left arm straight during the back swing and through impact of the golf club with the golf ball being struck.

The well executed golf swing involves hand-eye coordination. Therefore, a golfer should maintain eye contact with the golf ball during the back swing, down swing and through impact to executed a good swing. As a matter of fact, one of the "bugaboos" of today's golfer is the error colloquially referred to as "looking up". When a golfer looks up during his golf swing prior to striking the ball while executing his swing, he is almost always anticipating the desired flight of the ball and looking in the direction into which he hopes the ball will fly prior to making contact with the ball.

When a golfer "looks up", all sorts of unfortunate or undesirable results may happen. Often, when a golfer looks up, he will raise his head and at the same time raise his upper body a slight amount and the ball will be "topped". Topping the ball, depending on the degree, is a miss-hit in which the ball is struck by the lower leading edge of the face of a golf club. A golf ball struck in this fashion can be cut or otherwise deformed, and the shot flight will be different from that intended by the golfer. Frequently, the flight path of the ball will be much lower in introjectory than intended or desired, and the final results of the shot will be a ball in a position that the golfer did not intend.

Frequently, looking up will also result in what is referred to as a "shanked" shot. When the ball is shanked, the club strikes the ball in that position on the club face where the hosel of the club joins the striking face of the club. In effect, the ball is struck in part by the lowermost portion of the golf club shaft. When this occurs, with the right-handed golfer, the ball flies dramatically to the right of the intended line of flight. All golfers experience this phenomenon from time to time, and its cause is more often than not the golfer "looking up" during his swing. These unintended results frequently happen without a golfer being conscious of the reason for the poor shot, and frequently the faulty shot will be repeated several times in succession before a golfer realizes what he must do to correct his swing to avoid a faulty shot. This is particularly true in the case of a "shanked" shot, and all sorts of disadvantageous results to a golfer's game can happen as a golfer begins "shanking" the ball.

Virtually all low handicap golfers and golf professionals maintain eye contact with the golf ball throughout the swing until after it is struck by the golfs club and even with the spot previously occupied by the ball prior to impact. The maintenance of eye contact requires a steady head position throughout the golf swing and well after the ball has been struck. As a matter of fact, the legendary Ben Hogan authored a book about the game of golf in which he described the desired position of the golfer at the finish of the golf swing. In this book, it is stated that the right shoulder of the right-handed golfer comes into contact with the golfer's chin during follow-through and raises the golfer's head and chin from the position maintained during the swing up to that point. Mr. Hogan states in his book that the right shoulder area of his golf shirts would become worn after playing a number of rounds of golf in a particular shirt as a result of the right shoulder coming into contact with his chin.

In view of the desirability of maintaining a steady head position during a golf swing past impact, numerous methods and devices have been proposed in the prior art to aid a golfer in maintaining his head position steady. An example of such a device is shown in U.S. Pat. No. 3,350,102 which illustrates a head movement controlling device that is attached to the golfer's head and is supported by an arm to maintain the position of the attached device to the desired head position. Another device supported by mechanical arms which would indicate head movement on the part of the golfer during his swing is shown in U.S. Pat. No. 3,326,558. Both of theses devices are really not practical for a golfer to use except possibly at a golf practice location. In any event, neither of these devices is suitable for use by a golfer on a golf course.

Another device to assist a golfer in maintaining steady head position is shown in U.S. Pat. No. 1,636,086. The device of this patent discloses a cylindrical body, preferably made of rubber, and having a series of radially extending rubber fingers or projections. The device is positioned under the chin of the golfer and as the player turns his head, the projections or fingers will resist the turning movement of the head, as well as make the player conscious of the fact that he is turning his head. In an extreme case, the head may be moved enough so that the device would fall to the ground. The device of this patent must be positioned for golf swing since it is held in position by the golfer's chin exerting pressure on the device to maintain it in contact with the upper portion of the chest of the golfer.

Another device of the same general type is shown in U.S. Pat. No. 2,774,601. U.S. Pat. No. 3,536,329 shows a third form of device held into position between the golfer's chin and chest. These devices are particularly impractical since they require that the golfer maintain pressure on the device that is positioned between his chin and chest during the golf swing. Since the shoulders of a golfer turn during a properly executed swing, there will be relative movement between the golfer's chin position (assuming the golfer maintains a steady head) and the position of the chest which engages the device.

Accordingly, such devices are very impractical as a satisfactory device for assisting a golfer in maintaining a steady head position. Furthermore, all of the devices mentioned above are impractical to use on a golf course during a round of golf, and in some cases would be contrary to the rules of golf. The most desirable answer to the problem of a golfer keeping his head steady so that he does not "look up" requires a device which does not in any way interfere with the golf swing during the execution of the golf swing, does not tend to restrict any portion of the golfer's swing during the swing, and serves as a device for training the golfer to instinctively maintain the desired steady head position. Also, a device of this type should be passive in nature, that is, one which does not require active involvement by the golfer each time he addresses a golf ball and makes a golf swing.

SUMMARY OF THE INVENTION

It is, therefore, a primary object of the present invention to provide a golfer's training and practice device which will indicate to a golfer in a positive fashion that he has maintained a steady head position throughout the execution of his golf swing. It is a further object of the present invention to provide a device for indicating, with a positive signal that is audible or other detected by the golfer, that he has executed one of the elements of a desired golf swing, rather than indicating that he has committed an error or omission in his swing during the swing. It is a further object of the present invention to provide a golfer's practice device that may be worn during both practice and the playing of an actual round of golf which will indicate the correct maintenance of a steady head position during a golf swing. Also, it is an object of the present invention to provide a golfer's head movement indicator that does not in any way interfere or restrict the normal motions of a golfer during a correctly executed golf swing, or during other activities. Finally, it is an object of the present invention to provide a device for indicating to a golfer that he has maintained the correct steady head position during his swing which is simple to use and automatically responds to the correct golf swing execution without any activity on the part of the golfer other than correctly executing the golf swing.

These and other objects and advantages may be obtained by the golfer's head movement indicator device of the present invention which may be stated in general terms as a switch that is detachably mounted on the golfer's outer garments at the upper front portion of either the golfer's right shoulder or left shoulder, depending on whether he is right-handed or left-handed, a signal device that is activated by the golfer's shoulder contacting the detachably mounted switch member. The alarm or signal is carried on the golfer's body at a convenient location preferably at a remote location from the switch member. More specifically, and in one preferred form of the switch member, is a specially formed switch which includes a pair of elongated and sinuously shaped contact members each of which is attached to wires. The contacts are mounted in a spring-biased folded sheet-like mounting member, which is enclosed in and carried by a pocket member which may be detachably mounted, for example, by "velcro" to the shoulder of the golfer. The device also includes a signal device such as a small buzzer or other signal which is carried together with a source of power such as a small flashlight battery and is connected in series with the contacts of the switch by the wires. The switch is normally maintained in an open position by the bias of the spring member and the switch portion of the device is attached to the golfer's shoulder.

During the execution of a golf swing, if correctly done with the maintenance of a steady head position, while the golfer is wearing the device, as the golfer "follows through" after impacting the golf ball, his shoulder will come into contact with his chin, and this contact will momentarily close the switch and sound an audible signal. The golfer, therefore, has positive indication that he has maintained the correct steady head position. In the event the golfer does not maintain the correct head position but rather "looks up", the golfer's chin will not contact the switch member and no signal will be sounded. Thus, a golfer will know that he has failed to maintain correct head position during his swing because no signal will occur.

BRIEF DESCRIPTION OF THE DRAWING

A preferred embodiment of the present invention is illustrated in the accompanying drawing, and the advantageous, new and useful results obtained by the construction of the preferred embodiment are set forth in the following description and claims.

In the drawing.

Similar numerals refer to similar parts throughout the various figures of the drawing.

DESCRIPTION OF THE PREFERRED EMBODIMENT

Figure 1:
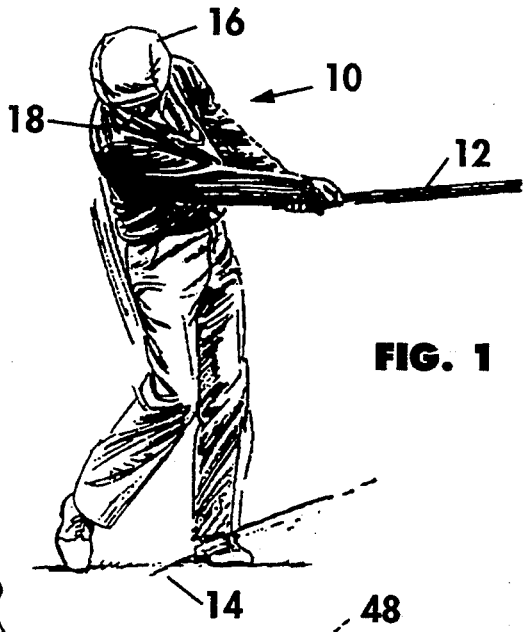
FIG. 1 is a diagrammatic illustration of a golfer's swing showing the position of the golfer after impact when he has maintained a steady head position during the swing.

Referring to FIG. 1, a golfer 10 is illustrated in the preferred position of a correctly executed golf swing shortly after impact and during the position known in the golf swing as the "follow through". At this point, the golf club 12 will have traveled past the point of impact 14 previously occupied by the golf ball (not shown) and the golfer's various body parts will be as illustrated in FIG. 1. The golfer's head 16 has maintained a Steady position during the illustrated swing, and the golfer's chin will at this point contact the golfer's right shoulder 18 as illustrated. The occurrence of the correct execution of the swing by a golfer is indicated to the golfer by the device of the present invention which includes an alarm or signal device 20 in the box bearing Label A in FIGS. 2 and 3. The signal device 20 is connected in series with a battery or other small lightweight source of power 22 contained in box B of FIGS. 2 and 3.

The device of the present invention also includes a switch member generally indicated at 30. Switch 30 includes a pair of contacts 32 and 34 that are connected in series with signal 20 and battery 22. Closing contact between contact members 32 and 34 will close the circuit with signal 20 and battery 22 and cause the signal 20 to be energized and sound an alarm, such as a "buzz" or "beep".

Figure 4:
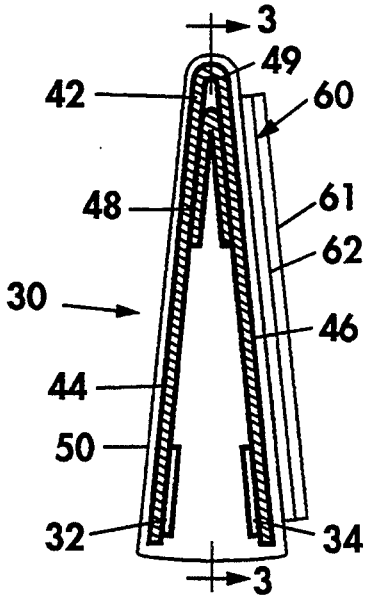
FIG. 4 is a cross section view of the device of the present invention shown in FIGS. 2 and 3, taken in the direction of lines 4—4 of FIG. 3.

Switch member 30 is comprised of several elements which cooperate together to provide a very lightweight reliable method of sending the desired signal to the golfer. Switch member 30 is formed from a folded sheet-like member 42 having a pair of leaves 44 and 46 which are positioned with a V-like cross section, as illustrated in FIG. 4, with leaves 44 and 46 almost touching or folded upon each other. At the base of the V, a spring bias member 48 maintains or exerts pressure on leaves 44 and 46 to urge them slightly apart. Contact 32 is mounted on leaf 44 and contact 34 is mounted on leaf 46 at a position outwardly from the base of the V and adjacent to the outer edge of each of leaves 44 and 46.

Sheet member 42 is preferably formed of a semistiff but yet resilient material, that is, one which can be easily deformed with light pressure so that contacts 32 and 34 may be brought together during use of the device. Many materials would be suitable for constructing sheet member 42. A number of plastic materials could be used, as well as a relatively stiff coated cardboard, or other sheet material may be used to form sheet member 42.

Figure 2:
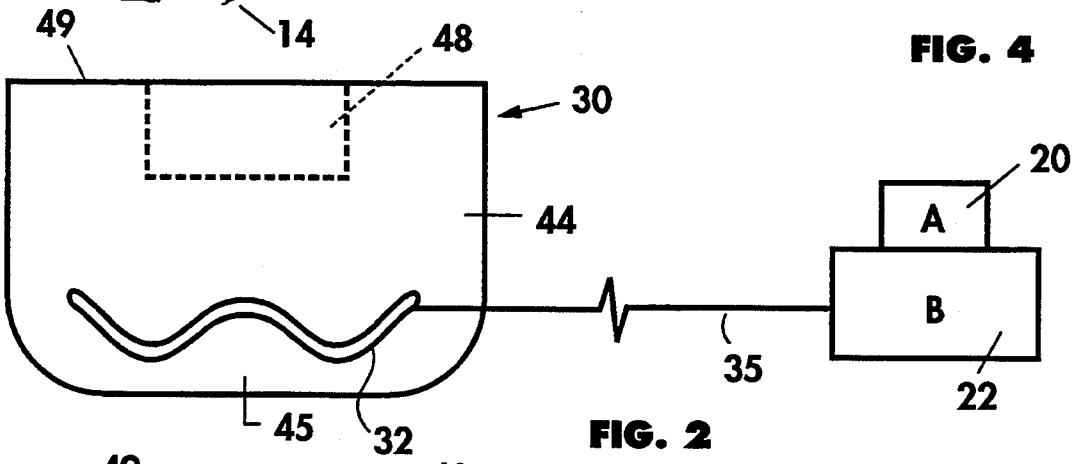
FIG. 2 is a view of the device of the present invention diagrammatically illustrating one leaf of the switch connected to a battery and signal.
Figure 3:
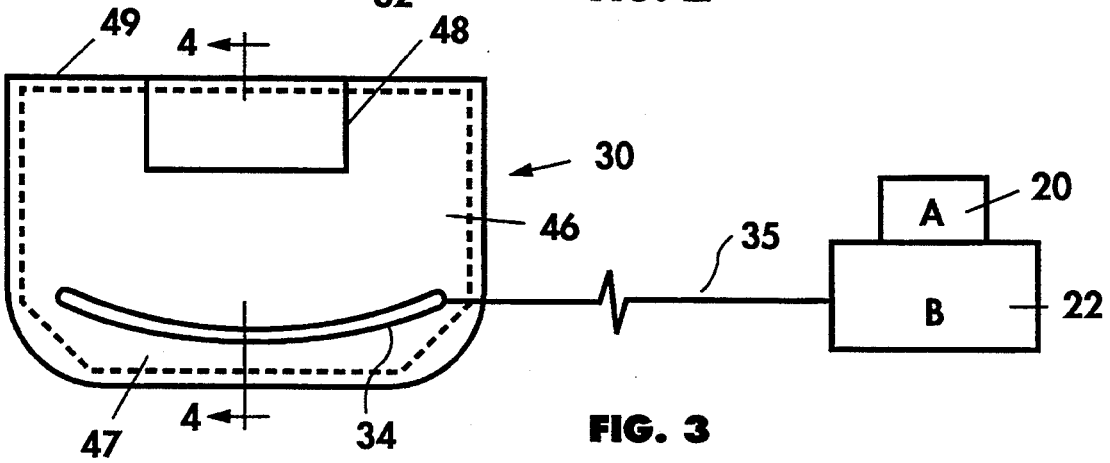
FIG. 3 is a view similar to FIG. 2 showing the opposite leaf of the switch portion of the device, as viewed on the lines 3—3 of FIG. 4.

Contacts 32 and 34 are preferably formed of a length of bare copper wire and are each connected to a wire 35 that is in turn connected in series with alarm 20 and battery 22. In FIGS. 2 and 3, which illustrate the contact members in plan view, the contact 32 is of a curved or sinuous configuration and contact 34 is shown as an arcuate portion or other simple curve. By forming one of the said contacts 32 in a sinuous or zigzag fashion, and the other contact in a straighter yet curved configuration, bringing leaves 44 and 46 together by pressure exerted on the leaves will insure that contact is made between contacts 32 and 34 somewhere along the lengths of the two contact members. This is particularly important in the present invention because during use, pressure exerted on leaves 44 and 46 to establish contact between the contacts may not be applied at exactly the same position on switch 30 each time the golfer swings his club even though the golfer has kept his head down in correct position.

The leaves 44 and 46 are maintained spaced slightly apart from each other at their outer edges 45 and 47, as shown in FIG. 4, and it is necessary to close the switch by urging leaves 44 and 46 toward one another to close the switch and establish contact. The spacing between leaves 44 and 46 at outer edges 45 and 47 is maintained by spring 48 at the base 49 of the V-portion of the sheet-like member 42. Spring member 46 can be formed of a variety of suitable materials, such as a folded-over piece of sheet metal or a small rectangle of folded-over sheet of elastic material, such as rubber. Pressure applied by spring 48 is only sufficient to maintain contacts 32 and 34 apart from one another and should be low enough so that these contacts 32 and 34 may be easily brought together by the golfer as his chin is contacted by his shoulder.

Switch member 30 is carried in a pocket 50 of a suitable fabric, and wires attached to contacts 32 and 34 extend from contacts 32 and 34 outside the pocket. The pocket includes one surface means for attaching the pocket and the switch member contained therein to the shirt or clothing of a golfer. The attaching means 60 includes the well known VELCRO material which is a detachable hook and loop material. One portion 61 of the VELCRO is attached to the appropriate location on the golfer's shirt. The other portion 62 of the VELCRO is attached to one face of pocket 50. The switch 30 and pocket 50 may be thereby easily but removably attached to and removed from the golfer's clothes. Other forms of attachment could, of course, be used.

To use the device, a suitable location on the golfer's shoulder is located and the switch 30 and pocket 50 are affixed to the golfer's shirt at this selected position. The wires comprising the circuit which are attached to contacts 32 and 34 extend out from the pocket 50 and are connected to the signal 20 and battery 22. Signal 20 and battery 22 are positioned at some other location on the golfer's person, such as a pants pocket. Switch 30 and pocket 50 may also be attached to the golfer's trousers waist band or belt. If desired, the wires can extend from contacts 32 and 34 to the shirt neck opening and inside the shirt to the location of the signal 20 and battery 22.

When installed on the golfer's clothing, the device of the present invention is very lightweight and unobtrusive. The switch portion 30 of the device is approximately 3" to $3\frac{1}{2}$"×2" and somewhat less than $\frac{1}{2}$" thick. Thus, the device will not interfere in any fashion with the golfer's normal activities or his golf swing. It is also extremely light in weight.

The battery and alarm member 22 and 20 can be contained in a small box-like member (not shown), if desired, and depending on the size of the battery used, the whole unit will fit into a container or enclosure that is approximately $1\frac{1}{4}$"×$2\frac{1}{4}$" by $\frac{1}{2}$". Again, this portion of the unit is very lightweight and can easily and readily be carried by a golfer without interference of either the golfer's swing or activities normally engaged in by a golfer, such as walking, or sitting, or driving a golf cart.

The device, after it has been placed in a desired position upon the body of the golfer. with switch member 30 located on the upper front portion of the golfer's shirt or other outer garment, and the alarm and battery located in some remote position, such as indicated above in the pocket of the golfer's trousers, will operate automatically in response to a golfer's correct golf swing. When a golfer is not engaged in making a golf swing or is engaged in other activities such as putting or driving a golf cart, switch member 30 will be maintained in open position, as shown in FIG. 4, by spring means 48 biasing contacts 32 and 34 away from each other. When a golfer makes a swing to hit the golf ball after addressing and taking a back swing, he will hopefully achieve the position shown in FIG. 1. When the golfer's body assumes the position shown in FIG. 1 with switch member 30 correctly positioned, the golfer's shoulder will come into contact with his chin, as illustrated in FIG. 1. When this happens, the slight pressure exerted between the shoulder and the golfer's chin will cause contacts 32 and 34 to come together, contact each other, and close the circuit in the system and thereby produce a signal to alert the golfer to the fact that he has kept his head down.

It should be understood that other types of signaling mechanisms can be used within the spirit and scope of the present invention. For example, a removable piece of cloth such as taffeta could be attached to the outer garment of the golfer at the correct position at the golfer's shoulder contact area and would function in the manner as the electronic alarm described above. That is, as the golfer's chin and shoulder contact each other, the noise made by contact with the cloth would alert the golfer that he has executed a correct golf swing. Also, the device could include a very small lightweight radio transmitter which could send a signal to a remotely located receiver to activate some other form of indicating device, such as a light. This type of alarm or similar signaling system might be particularly useful at a golf practice facility where a golf instructor is attempting to teach a number of students in a class. The instructor would be able to observe the results of a number of people without having to stand adjacent to or in close proximity to each person to determine if their alarm has signaled.

In the foregoing description, the pocket containing switch 30 is attached to the outer garment of a golfer by using "velcro" fasteners to attach the pocket to the garment. It should be understood that other forms of attachment of the pocket could be employed within the scope of the present invention. For example, a particular golfer might permanently install a pocket to his own shirts so that in those instances where he desires to use the device he could place the switch member 30 in the permanently installed pocket. If he did not desire to use the device at a particular time, it would be a simple matter to remove the device from his clothing. Also, other forms of removable attachment means such as snaps or pressure-sensitive adhesive could be used to achieve the purposes of the invention.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved golfer's head movement indicator is constructed, assembled and operated, the characteristics of the new construction, and the advantageous, new and useful results obtained; the new and useful structures, devices, elements, arrangements, parts, and combinations are set forth in the appended claims.

I claim:

1. A golfer's head movement indicating device including switch means enclosed in a flexible pocket means and adapted to be attached to the outer garment of a golfer at a location proximate to the upper front shoulder area of the golfer, a signal device connected to the switch means and a source of power connected to the signal means and the switch means, said switch means including a pair of elongated contact means adapted to close in response to pressure exerted on the switch means by the golfer's shoulder coming into contact with the golfer's chin whereby contact between the golfer's shoulder and the golfer's chin closes the switch means to activate the signal to indicate that the shoulder has contacted the chin.

2. A golfer's head movement indicating device as defined in claim 1 in which said switch means is formed from a folded sheet member, in which one contact is mounted on one of the sheet member leaves and a second contact is mounted on the second of the folded sheet member leaves, and in which spring means is interposed between the two leaves to maintain in the at-rest position a space between the two contacts.

3. A golfer's head movement indicating device as defined in claim 2 in which said switch means is mounted in pocket means having means for removably mounting the pocket to the outer garment of a golfer.

4. A golfer's head movement indicating device as defined in claim 1 in which said signaling means includes a transmitter means which sends a signal in response to closing the switch to activate a perceivable signal at a location remote from the golfer.

* * * * *